US008186784B2

(12) United States Patent
Clarke et al.

(10) Patent No.: US 8,186,784 B2
(45) Date of Patent: May 29, 2012

(54) CONTINUOUS INKJET PRINTING

(75) Inventors: Andrew Clarke, Haslingfield (GB); Sarah Rieubland, London (GB)

(73) Assignee: Eastman Kodak Company, Rochester, NY (US)

( * ) Notice: Subject to any disclaimer, the term of this patent is extended or adjusted under 35 U.S.C. 154(b) by 107 days.

(21) Appl. No.: 12/679,912

(22) PCT Filed: Sep. 9, 2008

(86) PCT No.: PCT/GB2008/003062
§ 371 (c)(1),
(2), (4) Date: Aug. 18, 2010

(87) PCT Pub. No.: WO2009/044096
PCT Pub. Date: Apr. 9, 2009

(65) Prior Publication Data
US 2010/0321449 A1 Dec. 23, 2010

(51) Int. Cl.
*B41J 29/38* (2006.01)
*B41J 2/14* (2006.01)
*B41J 2/16* (2006.01)

(52) U.S. Cl. ..... 347/6; 347/5; 347/47

(58) Field of Classification Search ..... None
See application file for complete search history.

(56) References Cited

U.S. PATENT DOCUMENTS 4,727,379 A 2/1988 Sourlis et al.
5,063,393 A 11/1991 Clark et al.
5,491,499 A 2/1996 Bibbe et al.
6,554,410 B2 4/2003 Jeanmaire et al.
6,713,389 B2 3/2004 Speakman
6,817,705 B1 11/2004 Crockett et al.
2002/0122102 A1 9/2002 Jeanmaire et al.

*Primary Examiner* — Matthew Luu
*Assistant Examiner* — Renee I Wilson
(74) *Attorney, Agent, or Firm* — Andrew J. Anderson

(57) ABSTRACT

A continuous inkjet method in which liquid passes through a nozzle, the liquid being jetted comprising one or more dispersed or particulate components and where the particle Peclet number, Pe, defined by $$Pe = \frac{1.25\phi_T \cdot d_{eff}^3 \sqrt{\mu_S}}{kT} \sqrt{\frac{\rho U^3}{x}}$$

is less than 500 and where the effective particle diameter, $d_{eff}$, is calculated as $$d_{eff} = \left( \frac{\int_0^\infty d^3 \phi(d)\, dd}{\int_0^\infty \phi(d)\, dd} \right)^{1/3}$$

where $\phi(d)$ is the volume fraction of the particles or components of diameter d (m) and where $\phi_T$ is the total volume fraction of dispersed or particulate components, $\mu_S$ is the viscosity of the liquid without particles (Pa·s), $\rho$ is the liquid density (kg/m$^3$), U is the jet velocity (m/s), x is the length of the nozzle in the direction of flow (m), k is Boltzmann's constant (J/K) and T is temperature (K). The present invention limits the magnitude of flow induced noise generated by particulate components in the ink to maximize the efficiency of drop formation and to minimize adverse interactions with the nozzle.

20 Claims, 5 Drawing Sheets

CONTINUOUS INKJET PRINTING

FIELD OF THE INVENTION

This invention relates to the field of continuous ink jet printing, especially in relation to inks or other jettable compositions containing particulate components.

BACKGROUND OF THE INVENTION

With the growth in the consumer printer market, inkjet printing has become a broadly applicable technology for supplying small quantities of liquid to a surface in an image-wise way. Both drop-on-demand and continuous drop devices have been conceived and built. Whilst the primary development of inkjet printing has been for graphics using aqueous based systems with some applications of solvent based systems, the underlying technology is being applied much more broadly.

There is a general trend of formulation of inkjet inks toward pigment based ink. This generates several issues that require resolution. Further, for industrial printing technologies, i.e. employing printing as a means of manufacture, the liquid formulation may contain hard or soft particulate components that are inherently difficult to handle with inkjet processes.

In a continuous inkjet process a stream of droplets is generated by a droplet generator. Often this droplet generator is an orifice in a thin plate through which liquid, an ink, is forced under pressure to form a liquid jet. It is well known that such a free jet is unstable to perturbations and will disintegrate into a series of droplets through the Rayleigh-Plateau instability. On average this disintegration occurs at a particular wavelength (approximately nine times the radius of the jet). It is also well understood that perturbing the jet via, for example, pressure fluctuations will regularise the jet breakup so that a continuous stream of regularly sized droplets is created. These droplets are conventionally charged via an electrode placed in close proximity to the point of breakup of the jet and subsequently deflected by an electrostatic field. The deflection causes drops to either fall on the substrate to be printed or to be captured and recirculated for re-use. There are many designs of nozzles for such a device. U.S. Pat. No. 4,727,379 describes a resonant cavity energised with a piezo electric device for use as a CIJ droplet generator, U.S. Pat. No. 5,063,393 describes a similar double cavity device and U.S. Pat. No. 5,491,499 describes a simple nozzle with piezo perturbation.

A new continuous inkjet device based on a MEMs formed set of nozzles has been recently developed (see U.S. Pat. No. 6,554,410). In this device a liquid ink jet is formed from a pressurized nozzle. One or more heaters are associated with each nozzle to provide a thermal perturbation to the jet. This perturbation is sufficient to initiate break-up of the jet into regular droplets. By changing the timing of electrical pulses applied to the heater large or small drops can be formed and subsequently separated into printing and non-printing drops via a gaseous cross flow. Although the droplets formed are regular, they nevertheless have a small velocity variation. As the drops travel from the breakoff point their position relative to each other therefore changes. At some distance from the breakoff point this position variation is large enough that neighbouring drops touch and coalesce. In a continuous inkjet device this would then lead to a sorting error or a placement error. Therefore minimisation of velocity variation is imperative.

When a liquid flows across a surface, the velocity of the liquid at or close to the solid surface is zero. In a long pipe the maximum liquid velocity is found in the centre of the pipe and the velocity profile across the pipe is parabolic. This is referred to as Poiseiulle flow. However, on entry to a pipe there is a finite distance, the entry region, where the flow field adopts that consistent with the pipe geometry. In the terminology of fluid mechanics there is a boundary layer that forms and grows until it is the size of the pipe at which point fully developed flow is achieved. The boundary layer thickness may be calculated as $$\delta = \sqrt{\frac{\mu x}{\rho U}} \tag{1}$$

where δ is the boundary layer thickness (m), μ is the liquid viscosity (Pa·s), x is the distance from the start of the pipe (m), ρ is the liquid density (kg/m$^3$) and U the liquid velocity (m/s). The nozzle in an inkjet droplet generator is a very short pipe i.e. too short for fully developed flow to be achieved. Therefore only a boundary layer thickness of liquid next to the nozzle wall is sheared.

Many modern inkjet ink formulations use pigments, a coloured particulate. The advantages of these are well known in the art, in particular providing for better colour gamut and greater lifetime of the printed image. The science of particulates dispersed within liquids, colloid science, is well known. If the particle size is small enough and the density low enough, then Brownian motion is sufficient to cause the particles to remain suspended in the liquid rather than settle out. For inkjet inks, the particulates used usually fulfil this requirement, though there are inventions to allow for inks that do settle e.g. U.S. Pat. No. 6,817,705 B1. More recently metallic particulates have been used which, because of their density, can settle more easily. Particulates may be spherical in shape, but most often are not. Nevertheless, methods to measure the size of particles are often based on measuring the diffusion constant and then from the Stokes-Einstein relation recovering the particle diameter. This process thereby leads to an effective particle diameter that is defined as the equivalent spherical particle that would behave in the same hydrodynamic way and is therefore referred to as the hydrodynamic diameter. Most often the manufacturing process for pigment particulates leads to a distribution of effective particle diameters, referred to as polydispersity. A common way of combining particle diameters to form an average which is relevant for the present invention is to form the volume average thus, $$d_{eff} = \left(\frac{\sum_j d_j^3 \phi_j}{\phi_{total}}\right)^{1/3} \tag{2}$$

$$\phi_{total} = \sum_j \phi_j \tag{3}$$

where $d_{eff}$ is the volume average effective particle diameter in nanometers (nm), $d_j$ is the particle diameter (nm) of population j and $\phi_j$ is the volume fraction of population j. This can of course be generalised for a continuous distribution of particle diameters, $$d_{eff} = \left(\frac{\int_0^\infty d^3 \phi(d) d(d)}{\phi_{total}}\right)^{1/3} \tag{4}$$

-continued $$\phi_{total} = \int_0^\infty \phi(d)dd \quad (5)$$

where $\phi(d)$ is the fraction of particles with diameter between d and d+dd.

When a particle is placed in a liquid under shear it will experience a force directed up the shear gradient, i.e. from high shear regions to low shear regions. This is the well known Magnus effect. It will for example cause particulates to be directed toward the centre of a channel or pipe.

There are numerous known methods and devices relating to the formation and use of droplets. For example U.S. Pat. No. 6,713,389 describes placing multiple discrete components on a surface for the purpose of creating electronic devices.

PROBLEM TO BE SOLVED BY THE INVENTION

There are several problems relating to the formulation of ink drops where the ink contains hard or soft particulate material.

Inks containing dispersed material or particulates give rise to increased noise, i.e. to increased drop velocity variation. This leads to reduced small drop merger length. Small drop merger length is a key property of the MEMs continuous ink jet (CIJ) system.

Increased drop velocity variation also leads to drop placement error in a printing process.

Particulates in the ink formulation are also detrimental to the ink jet nozzle, causing wear.

The present invention aims to address these problems.

SUMMARY OF THE INVENTION

The present invention limits the magnitude of flow induced noise generated by particulate components in the ink to maximise the efficiency of drop formation and to minimise adverse interactions with the nozzle.

According to the present invention there is provided a continuous inkjet method in which liquid passes through a nozzle, the liquid being jetted comprising one or more dispersed or particulate components and where the particle Peclet number, Pe, defined by $$Pe = \frac{1.25\phi_T \cdot d_{eff}^3 \sqrt{\mu_S}}{kT}\sqrt{\frac{\rho U^3}{x}}$$

is less than 500 and where the effective particle diameter, $d_{eff}$, is calculated as $$d_{eff} = \left(\frac{\int_0^\infty d^3\phi(d)dd}{\int_0^\infty \phi(d)dd}\right)^{1/3}$$

where $\phi(d)$ is the volume fraction of the particles or components of diameter d(m) and where $\phi_T$ is the total volume fraction of dispersed or particulate components, $\mu_S$ is the viscosity of the liquid without particles (Pa·s), $\rho$ is the liquid density (kg/m$^3$), U is the jet velocity (m/s), x is the length of the nozzle in the direction of flow (m), k is Boltzmann's constant (J/K) and T is temperature (K).

The invention further provides a method of continuous inkjet printing in which liquid passes through a nozzle and wherein the liquid being jetted comprises one or more dispersed or particulate components and wherein the product of effective particle diameter, $d_{eff}$, of said components and the cube root of the total volume fraction, $\phi_T$, of particulate or dispersed components is less than 95 nanometers, the effective particle diameter, $d_{eff}$, being calculated as $$d_{eff} = \left(\frac{\int_0^\infty d^3\phi(d)dd}{\int_0^\infty \phi(d)dd}\right)^{1/3}$$

and $\phi_T$, being calculated as $$\phi_T = \int_0^\infty \phi(d)dd$$

where $\phi(d)$ is the volume fraction of the particles or components of diameter d.

ADVANTAGEOUS EFFECT OF THE INVENTION

By ensuring the dispersed components or particles are directed away from contact with the wall the propensity for nozzle wear is significantly reduced.

As it is the interaction of dispersed material or particulates with the boundary layer within the nozzle that generates the observed drop velocity fluctuations, by providing that the size of interaction of the dispersed material or particulates within the nozzle boundary layer are small, the drop velocity fluctuations are minimised and small drop merger length is maximised.

BRIEF DESCRIPTION OF THE DRAWINGS

The invention will now be described with reference to the accompanying drawings in which.

DETAILED DESCRIPTION OF THE INVENTION

Figure 1A:
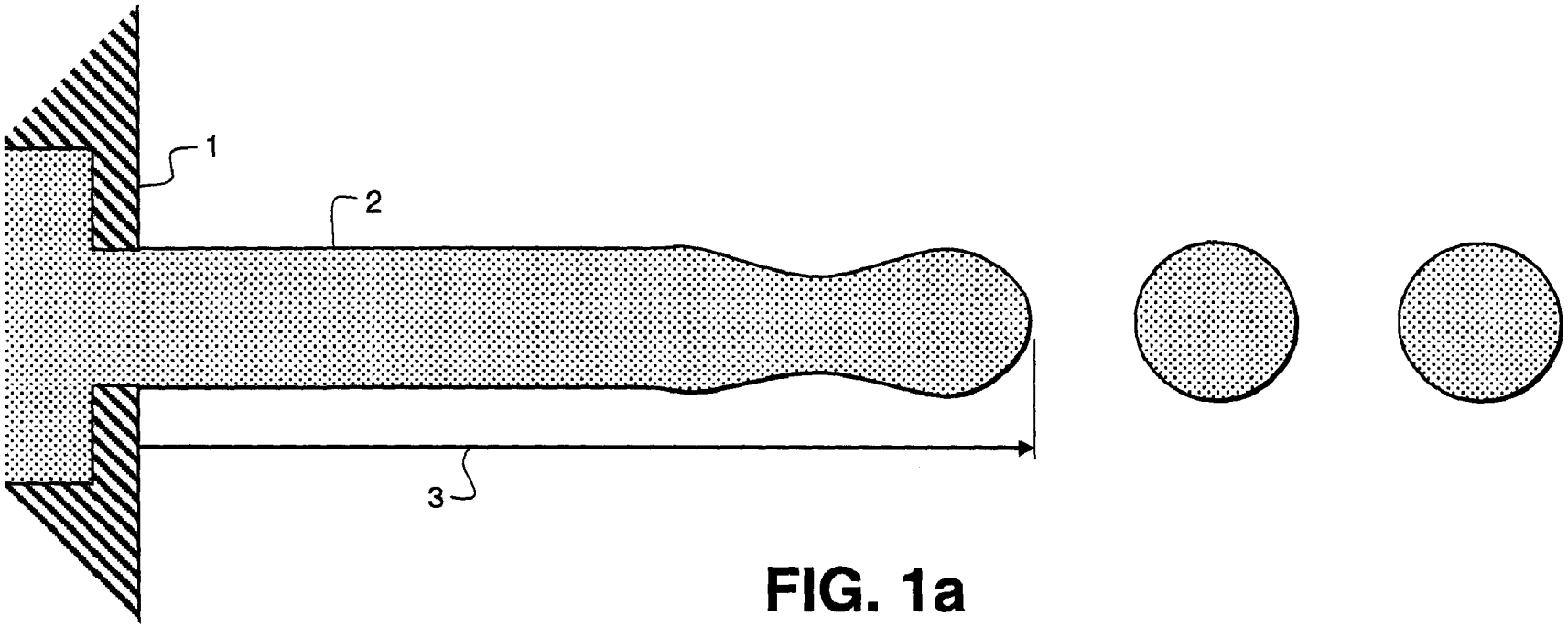
FIGS. 1*a* and 1*b* are schematic diagrams illustrating the jet break off length and the small drop merger length.
Figure 1B:
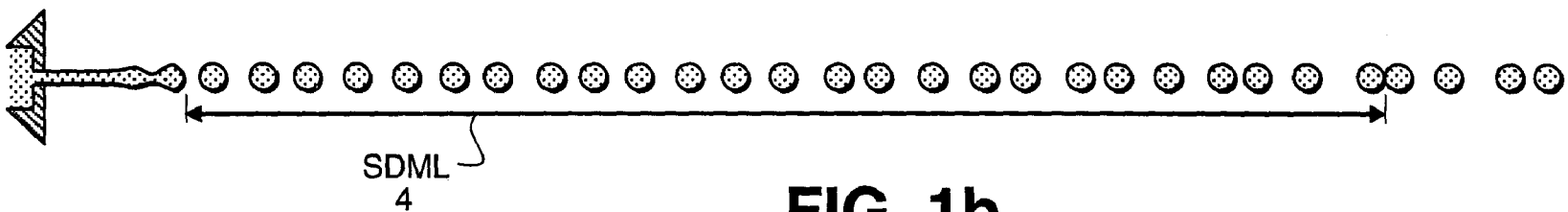

This invention relates to continuous ink jet printing rather than to drop on demand printing. Continuous ink jet printing uses a pressurized liquid source to supply a nozzle, which thereby produces a liquid jet. Such a liquid jet is intrinsically unstable and will naturally break to form a continuous stream of droplets. A perturbation to the jet at or close to the Rayleigh frequency, i.e. the natural frequency of break-up, will cause the jet to break regularly. The droplets of liquid or ink may then be directed as appropriate. FIG. 1*a* illustrates a nozzle 1 and jet 2, forming droplets a distance 3 from the nozzle 1. The distance 3 is the breakoff length. FIG. 1*b* illustrates the small drop merger length (SDML) 4 where neighbouring droplets with slightly differing velocities coalesce. Note the small drop merger length is the smallest distance at which neighbouring droplet merger is observed.

Figure 2:
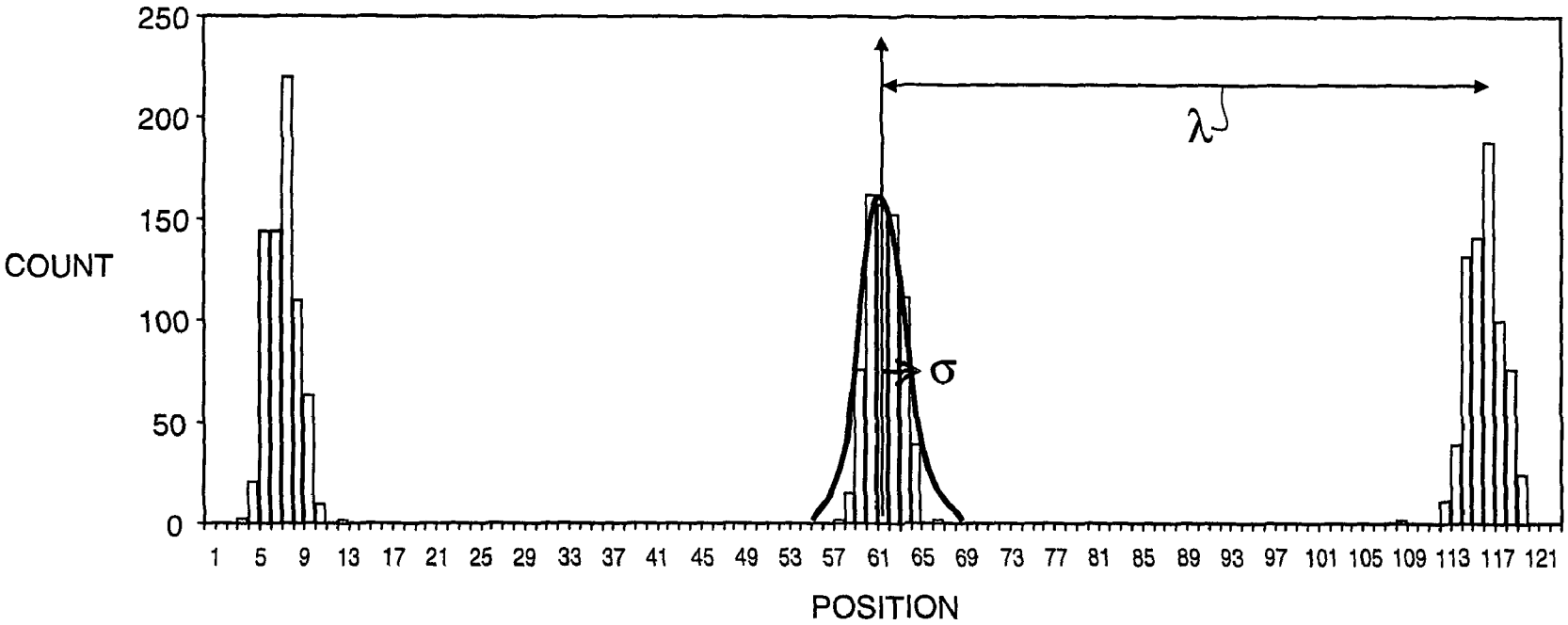
FIG. 2 is a plot of drop position variation allowing measurement of small drop merger length.

FIG. 2 illustrates the measurement of drop velocity variation. Repeated measurements are made at the average droplet formation frequency, i.e. the image is strobed such that the drops appear to be stationary. The position of the droplets are measured and a histogram of the positions drawn. FIG. 2 shows such a plot for three droplets. The standard deviation of position, σ, of each droplet at its distance, L, from the breakoff point can then be obtained. The droplet velocity variation is then calculated as $$\frac{\delta U}{U} = \frac{\sigma}{L} \tag{6}$$

Where σ is the standard deviation of the droplet position (m) and L is the average distance of the droplet from the breakoff position (m). The SDML is defined as the distance at which the average separation between drops is six times the standard deviation from the position variation. We therefore relate the velocity fluctuation to SDML, $$SDML \equiv \frac{\lambda}{6}\left(\frac{\delta U}{U}\right)^{-1} \tag{7}$$

with λ the average droplet spacing or wavelength (m), δU the droplet velocity standard deviation (m/s) and U the average droplet velocity (m/s). Thus a small droplet velocity variation leads to a large small drop merger length as is desired.

Figure 3:
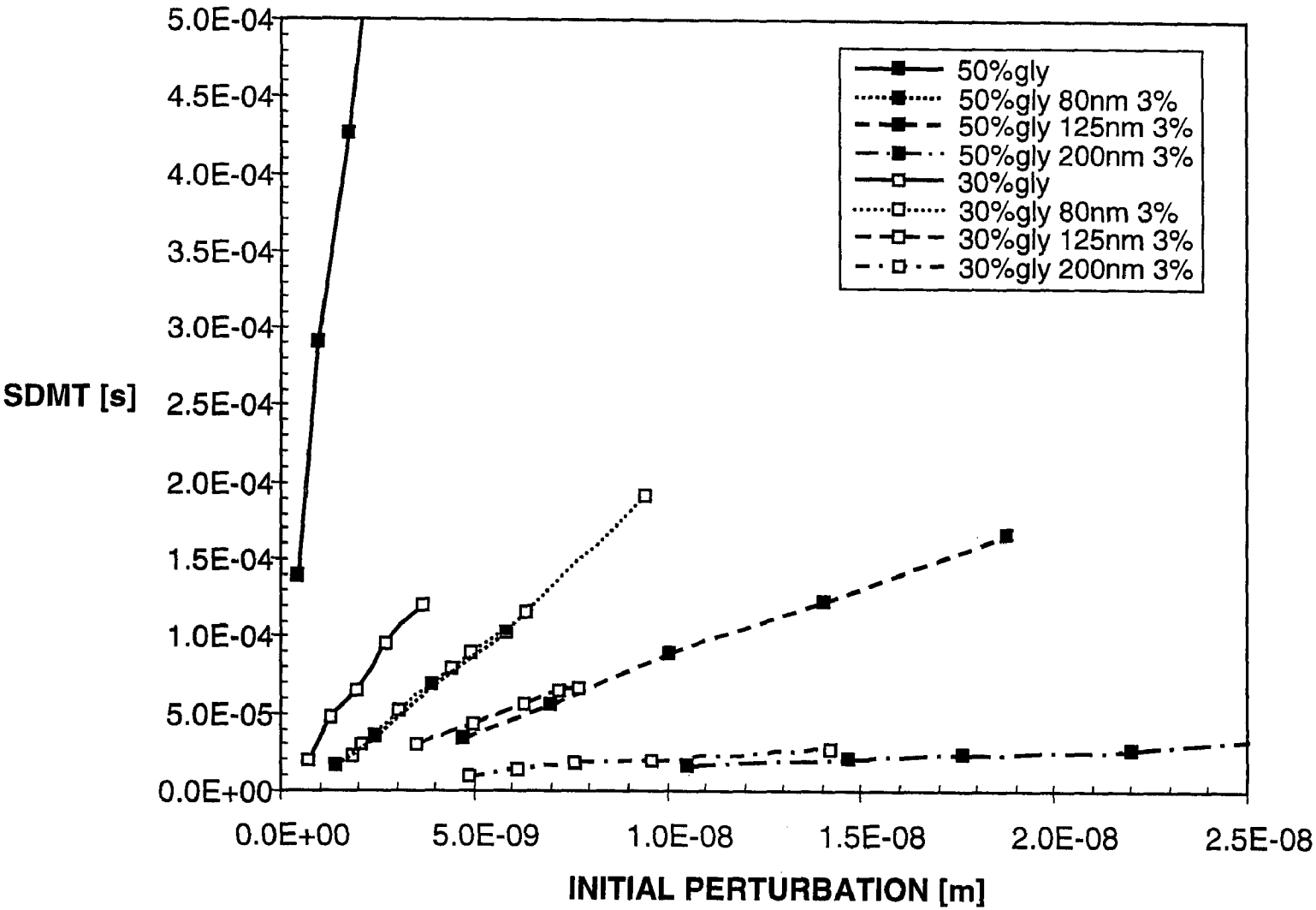
FIG. 3 is a plot of measured small drop merger length as a function of initial perturbation.

FIG. 3 shows measurements of SDML made in this way for various liquids and conditions plotted as a function of initial perturbation. The initial perturbation is derived from a measurement of the breakoff length using the following relationship $$\xi_i = R\cdot\exp(-L_B U_{jet}\alpha) \tag{8}$$

where η is the jet radius (m), $L_B$ is the breakoff length measured from the nozzle (m), $U_{jet}$ is the velocity of the jet (m/s) and α is the perturbation growth rate ($s^{-1}$). The growth rate α is defined by the jet parameters and can be found as the positive root of the following quadratic $$\alpha^2 + \frac{3\eta(kR)^2}{\rho R^2}\alpha - \frac{\gamma}{2\rho R^3}(1-(kR)^2)(kR)^2 = 0 \tag{9}$$

where η is the liquid low shear viscosity (Pa·s), σ is the liquid density ($kg/m^3$), γ is the liquid surface tension (N/m), and k is the perturbation wavevector ($m^{-1}$) ($=2\pi/\lambda=2\pi f/U_{jet}$, f the perturbation frequency (Hz)).

The droplet velocity variation originates in a fluctuation in the breakoff length which we can find by considering the breakoff time. Rearranging equation (8) we obtain the breakoff time, that is the time between the liquid exiting the nozzle and it forming a drop, $$t_B = L_B U_{jet} = \frac{1}{\alpha}\ln\left(\frac{R}{\xi_i}\right) \tag{10}$$

If we allow for a fluctuation in break-off time, $\delta t_B$, due to a fluctuation in initial perturbation, $\delta\xi_i$, then we find, $$\delta t_B = -\frac{1}{\alpha}\ln\left(1+\frac{\delta\xi_i}{\xi_i}\right) \tag{11}$$

which of course gives rise to a break-off length fluctuation, δl, $$\delta l = U_{jet}\delta t_B \tag{12}$$

A break-off length fluctuation implies a fluctuation in the mass of each drop, δM, $$\delta M = \rho\pi R^2\delta l \tag{13}$$

which in turn implies, via conservation of momentum, a fluctuation in the drop velocity, $$\frac{\delta M}{M} = \frac{\delta l}{\lambda} = -\frac{\delta U}{U} \tag{14}$$

Hence combining equations (11), (12) and (14), $$\frac{\delta U}{U} = \frac{U_{jet}}{\lambda\alpha}\ln\left(1+\frac{\delta\xi_i}{\xi_i}\right) \tag{15}$$

where U is the drop velocity (m/s), λ the breakup wavelength (m), α the frequency dependent perturbation growth rate ($s^{-1}$), $\xi_i$ the initial perturbation (m) and $\delta\xi_i$ the noise on the initial perturbation (m). In equation (15) the In( )function will, to leading order and providing the noise is small compared to the perturbation, be well approximated by $\delta\xi_i/\xi_i$ and therefore the velocity spread should be simply proportional to the perturbation noise-to-signal ratio.

It therefore follows that to minimise the drop velocity fluctuation and therefore maximise the small drop merger length, either the fluctuations in the initial perturbation, $\delta\xi_i$ should be minimised, or the size of the initial perturbation, $\xi_i$, should be maximised.

Figure 4:
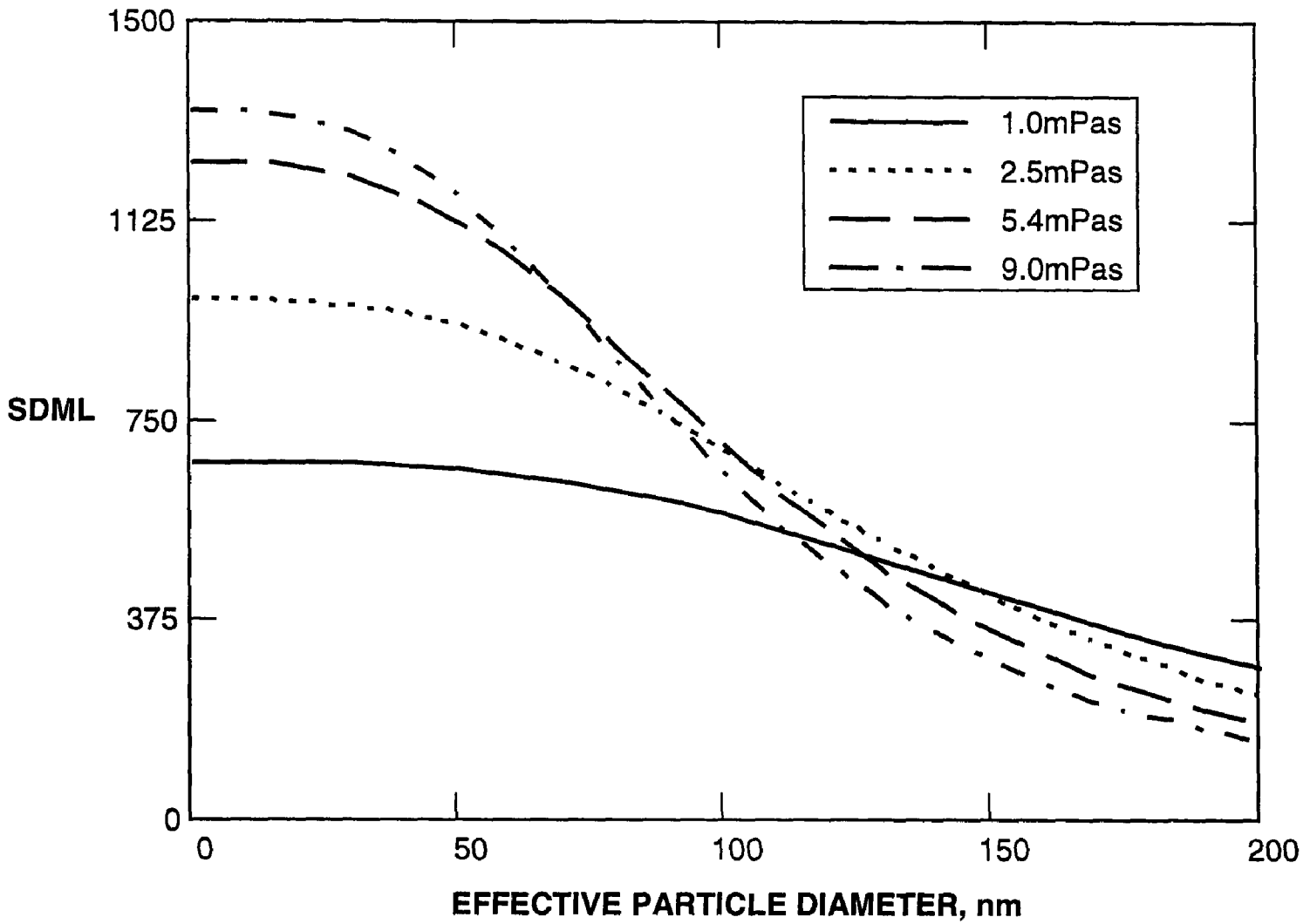
FIG. 4 is a plot of measured small drop merger length as a function of effective particle size.

FIG. 4 shows fits to data plotted as a function of effective particle diameter (as calculated using equations (4) and (5)) for several viscosities, and a single effective perturbation amplitude and a single total volume fraction of 0.03. It is a remarkable and surprising fact that for no particles or small particles, the SDML increases as the viscosity of the liquid is increased whereas for large particles the opposite is true; as the viscosity is increased, SDML decreases. It is therefore appropriate to choose an effective particle diameter where the curves cross as a maximal particle size useful for the practice of continuous inkjet printing particularly with the earlier described MEM's device.

The fluctuations in the initial perturbation, $\delta\xi_i$ arise either as intrinsic noise within the process, such as vibration or thermally excited capillary waves etc., or as flow fluctuations induced by particulates moving through the nozzle boundary layer. Sources of intrinsic noise are reduced by higher viscosities, whereas particulates in the boundary layer exert a greater effect with a higher background viscosity.

Figure 5:
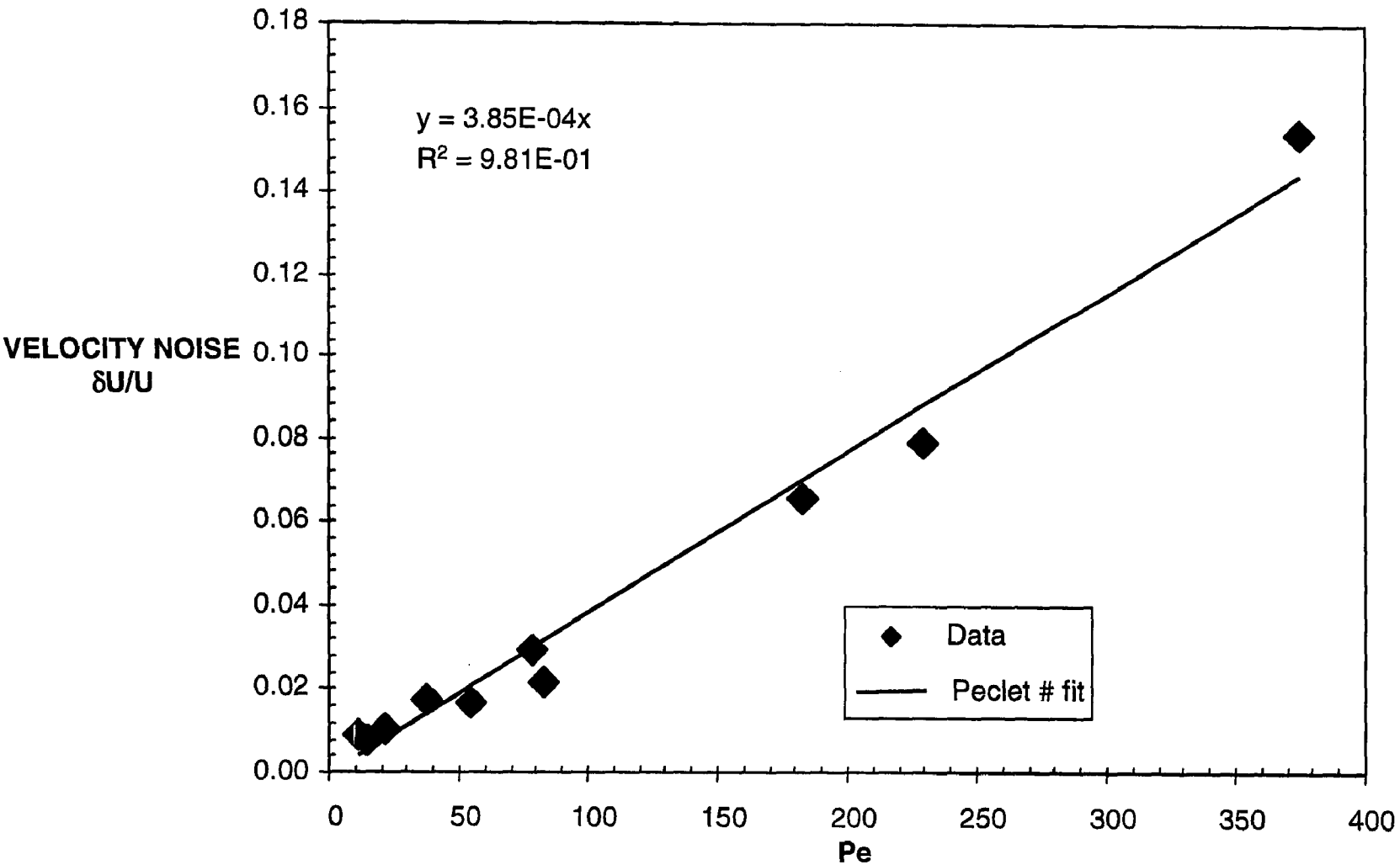
FIG. 5 is a plot of droplet velocity noise as a function of particle Peclet number.

Whilst limiting particle size is a useful condition to maintain a low drop velocity spread and therefore a large SDML, it is not the only method. The particles are carried within the liquid flow through the nozzle where they interact with the boundary layer which is formed at the nozzle wall. The thickness of the boundary layer depends on the liquid viscosity, the liquid velocity as it exits the nozzle and the nozzle length in the direction of flow. Furthermore the distance over which a particle will move relative to the flow due to Brownian motion depends strongly on it size as given by the Einstein relation. The ratio of these two lengths is a Peclet number. It has been unexpectedly discovered that the drop velocity noise δU/U is proportional to a particle-nozzle Peclet number defined as, $$Pe = \frac{1.25\phi_T \cdot d_{eff}^3 \sqrt{\mu_S}}{kT} \sqrt{\frac{\rho U^3}{x}} \tag{16}$$

where $\phi_T$ is the total volume fraction of dispersed or particulate components, $\mu_S$ is the background viscosity of the liquid i.e. the liquid without particles (Pa·s), ρ is the liquid density (kg/m$^3$), U is the liquid velocity as it exits the nozzle (m/s), x is the length of the nozzle in the direction of flow (m), k is Boltzmann's constant (J/K) and T is temperature (K). The relationship between δU/U and Pe is shown in FIG. 5 for a particular initial perturbation size and particular nozzle.

It has further been found that the drop velocity variation for a particular particulate composition is dependent on the size of the jet, R, $$\frac{\delta U}{U} \propto \left(\frac{\delta}{R}\right)^{3/2} Pe \tag{17}$$

Where R is the nozzle radius (m), and δ is the boundary layer thickness (m) as defined in equation (1).

Whilst drop velocity noise, δU/U, can be reduced by increasing the size of the jet perturbation, there are limits imposed by any particular system. For example in the case of a nozzle with a heater that thermally perturbs the jet, the heater will fail at some power level (for example via thermal stress) which therefore restricts the maximum perturbation size. Thus, ensuring a limit on the source of the noise, i.e. the fluctuations in the initial perturbation, by providing for a limit on the Peclet number becomes necessary.

To minimise the drop velocity variation and therefore maximise the SDML it is therefore preferable to minimise the value of the Peclet number defined in equation (16) and thereby minimise δU/U in equation (17). It is preferable that Pe<500, and more preferable that Pe<250. To achieve this the material and jetting parameters can also be optimised for the process. For nozzle length x, it is preferable that it is as short as possible to minimise the pressure required to form the jet, whereas to minimise Pe it is preferable to maximise x. In fact the boundary layer thickness δ also depends on x and thus x should preferably be less than about 10 micrometers. For liquid viscosity, it is advantageous to have higher viscosity, for freedom of formulation, but lower viscosity for ease of jetting and recirculation. However to minimise δU/U it is preferable to minimise viscosity, and therefore most preferable for the liquid viscosity to be less than 10 mPa·s. For nozzle radius it is desirable that it is as small as possible to allow the highest possible printing resolution to be achieved. However as the radius is reduced δU/U increases. Nozzle radius is most preferably less than about 25 micrometers. To allow the highest possible printing resolution to be achieved at the necessarily large distances between the nozzle and the substrate the jet velocity, U, should be as high as possible preferably greater than 20 m/s. For particle size, to minimise Pe, $d_{eff}$ should be as small as possible consistent with the desired function of the particles. It is most preferable that $d_{eff}$ be less than about 125 nanometers. Alternatively, the product of the effective diameter and the cube root of the total volume fraction $$D=(\phi_T \cdot d_{eff}^3)^{1/3}=\phi_T^{1/3} d_{eff} \tag{18}$$

should be minimised consistent with other constraints such as maintaining colour density, preferably D should be less than 95 nanometres, more preferably less than 60 nanometres, more preferably still less than 40 nanometres.

The liquid composition or ink may contain one or more dispersed or dissolved components including pigments, dyes, monomers, polymers, metallic particles, inorganic particles, organic particles, dispersants, latex and surfactants well known in the art of ink formulation. This list is not to be taken as exhaustive.

It is well understood in the art that high volume fractions of dispersed material lead to increases in liquid viscosity, thus to maintain a viscosity as low as reasonable so as to allow effective jetting it is preferable to keep the total dispersed or particulate volume fraction less than about 0.25.

The invention has been described in detail with reference to preferred embodiments thereof. It will be understood by those skilled in the art that variations and modifications can be effected within the scope of the invention.

The invention claimed is:

1. A continuous inkjet method in which liquid passes through a nozzle, the liquid being jetted comprising one or more dispersed or particulate components and where the particle Peclet number, Pe, defined by $$Pe = \frac{1.25\phi_T \cdot d_{eff}^3 \sqrt{\mu_S}}{kT} \sqrt{\frac{\rho U^3}{x}}$$

is less than 500 and where the effective particle diameter, $d_{eff}$, is calculated as $$d_{eff} = \left(\frac{\int_0^\infty d^3 \phi(d) dd}{\int_0^\infty \phi(d) dd}\right)^{1/3}$$

where φ(d) is the volume fraction of the particles or components of diameter d (m) and where $\phi_T$ is the total volume fraction of dispersed or particulate components, $\mu_s$ is the viscosity of the liquid without particles (Pa·s), ρ is the liquid density (kg/m$^3$), U is the jet velocity (m/s), x is the length of the nozzle in the direction of flow (m), k is Boltzmann's constant (J/K) and T is temperature (K).

2. The method of claim 1 wherein said Peclet number is less than 250.

3. The method of claim 1 wherein the jet velocity, U, is greater than about 20 m/s.

4. The method of claim 1 wherein the length of the nozzle, x, is less than about 10 micrometers.

5. The method of claim 1 wherein the liquid viscosity, $\mu_s$, is less than about 10 mPa·s.

6. The method of claim 1 wherein the effective particle size, $d_{eff}$, is less than about 125 nanometers.

7. The method of claim 1 wherein the total volume fraction of dispersed or particulate components, $\phi_T$, is less than 0.25.

8. The method of claim 1 wherein the continuous inkjet nozzle is formed via a MEMs technology.

9. The method of claim 1 wherein a perturbation to the liquid jet is generated by a heating element.

10. The method of claim 1 wherein droplets are sorted for printing and non-printing by means of a flow of gas.

11. The method of claim 1 wherein said dispersed or particulate component contains one of or a composite of a latex, a pigment, a metal particle, an organic particle, an inorganic particle, a dye, a monomer, a polymer, a dispersant, a surfactant.

12. A method of continuous inkjet printing in which liquid passes through a nozzle and wherein the liquid being jetted comprises one or more dispersed or particulate components and wherein the product of effective particle diameter, $d_{eff}$, of said components and the cube root of the total volume fraction, $\phi_T$, of particulate or dispersed components is less than 95 nanometers, the effective particle diameter, $d_{eff}$, being calculated as $$d_{eff} = \left( \frac{\int_0^\infty d^3 \phi(d) dd}{\int_0^\infty \phi(d) dd} \right)^{1/3}$$

and $\phi_T$ being calculated as $$\phi_T = \int_0^\infty \phi(d) dd$$

where $\phi(d)$ is the volume fraction of the particles or components of diameter d.

13. The method of claim 12 wherein the product of effective particle diameter, $d_{eff}$, of said components and the cube root of the total volume fraction, $\phi_T$, of particulate or dispersed components is less than about 60 nm.

14. The method of claim 12 wherein the product of effective particle diameter, $d_{eff}$, of said components and the cube root of the total volume fraction, $\phi_T$; of particulate or dispersed components is less than about 40 nm.

15. The method of claim 12 wherein said dispersed or particulate component contains one of or a composite of a latex, a pigment, a metal particle, an organic particle, an inorganic particle, a dye, a monomer, a polymer, a dispersant, a surfactant.

16. The method of claim 12 wherein the continuous inkjet nozzle is formed via MEMs technology.

17. The method of claim 12 wherein a perturbation to the liquid jet is generated by a heating element.

18. The method of claim 12 wherein droplets are sorted for printing and non-printing by means of a flow of gas.

19. The method of claim 12 wherein the total volume fraction of dispersed or particulate components is less than 0.25.

20. The method of claim 1, wherein the product of effective particle diameter, $d_{eff}$, of said components and the cube root of the total volume fraction, $\phi_T$ of particulate or dispersed components is less than 95 nanometers.

* * * * *